US007181805B2

(12) United States Patent
Tremblay et al.

(10) Patent No.: US 7,181,805 B2
(45) Date of Patent: Feb. 27, 2007

(54) SASH WINDOW HINGE

(76) Inventors: Martin Tremblay, 7515, Jodelle, Laval Ouest, Québec (CA) H7R 5L5; Jean Dupuis, 8169, rue Lajeunesse, Montréal, Québec (CA) H2P 2E4

( * ) Notice: Subject to any disclaimer, the term of this patent is extended or adjusted under 35 U.S.C. 154(b) by 0 days.

(21) Appl. No.: 10/666,041

(22) Filed: Sep. 22, 2003

(65) Prior Publication Data

US 2004/0055113 A1 Mar. 25, 2004

(30) Foreign Application Priority Data

Sep. 18, 2002 (GB) ..... 0221652.1

(51) Int. Cl.
*E05D 3/06* (2006.01)
*E05D 15/32* (2006.01)

(52) U.S. Cl. ..... 16/366; 16/370; 16/193; 16/362; 49/252

(58) Field of Classification Search ..... 16/366, 16/370, 193, 239, 242, 362; 49/248, 250–252, 49/260, 388
See application file for complete search history.

(56) References Cited

U.S. PATENT DOCUMENTS

| | | | | | |
|---|---|---|---|---|---|
| 4,790,106 | A | * | 12/1988 | La See | 49/252 |
| 4,980,947 | A | * | 1/1991 | McQuigge | 16/235 |
| 5,040,267 | A | * | 8/1991 | Dallmann | 16/239 |
| 5,083,344 | A | * | 1/1992 | Pettit et al. | 16/254 |
| 5,093,960 | A | * | 3/1992 | Pemberton | 16/360 |
| 5,152,102 | A | * | 10/1992 | La See | 49/252 |
| 5,307,539 | A | * | 5/1994 | Bauman | 16/239 |
| 5,491,930 | A | * | 2/1996 | La See | 49/252 |
| 5,794,310 | A | * | 8/1998 | Dallmann | 16/362 |
| 5,964,011 | A | * | 10/1999 | Ruston et al. | 16/239 |
| 6,112,371 | A | * | 9/2000 | Tremblay | 16/362 |
| 6,643,896 | B2 | * | 11/2003 | Carrier | 16/242 |

FOREIGN PATENT DOCUMENTS

| | | | | |
|---|---|---|---|---|
| CA | 2231496 | A | * | 1/1999 |
| GB | 2293411 | A | * | 3/1996 |
| GB | 2325273 | A | * | 11/1998 |
| JP | 03122384 | A | * | 5/1991 |
| JP | 07317412 | A | * | 12/1995 |
| JP | 10025942 | A | * | 1/1998 |
| JP | 2001355372 | A | * | 12/2001 |

* cited by examiner

*Primary Examiner*—Chuck Y. Mah

(57) ABSTRACT

A sash window hinge for pivotally connecting a window having a window sash to a window frame. The window hinge includes an elongated track having a track base wall attachable to the window frame. The track also includes a track flange extending from at least a portion of a base wall first longitudinal edge The track flange defines a flange retaining section. The window hinge also includes an elongated sash arm attachable to the window sash and a carriage component pivotally attached to the sash arm. The carriage component is mounted on the base wall in a carriage operational configuration for slidable movement along the track longitudinal axis between an open window position and a closed window position while being guided by the track flange and retained by the flange retaining section. The window hinge further includes a support arm for pivotally linking the sash arm and the track. A securing structure other then the flange retaining section extends between the track base wall and the carriage component for maintaining the carriage component in the carriage operational configuration. The securing structure prevents the carriage component from being separated from the flange retaining section when pressure is exerted on the window.

4 Claims, 4 Drawing Sheets

14
22
80
100
84
96
90
88
94
98
96
86
9
82
33
28
26
33
58
16
12
32
30
58
54
60
20
64
16
33
64
24

SASH WINDOW HINGE

FIELD OF THE INVENTION

The present invention relates to the general field of windows and is particularly concerned with a window hinge having improved locking and adjustment features.

BACKGROUND OF THE INVENTION

Exterior windows mounted in the walls of residential or commercial buildings are typically provided to allow for a view of the exterior and the transmission of light into the building. They are also expected to maintain a weather tight barrier against environmental elements such as wind and rain. Preferably, exterior windows offer the capability of being opened for ventilation during favorable conditions.

Originally, most windows used in residential settings were of the guillotine-type wherein there is provided either a fixed upper window portion and a moveable lower window portion or alternatively where upper and lower window portions are moveable. Subsequently, side opening crank-type windows became popular and many suitable mechanisms were developed for opening and closing the windows. One particularly popular type of windows is the so-called sash-type window.

Window hinges are known in the art for providing pivotal movement of the window between open and closed position. Typically, a hinge assembly mounts a window sash to a window frame and controls the opening and closing of the window.

Window hinges typically involve a generally elongated track mounted to the window frame, a sash arm mounted to the window sash and a support arm interconnecting the track and sash arms with the support arm being pivotally connected to both the track and the sash arms.

The sash arm is pivotally connected either directly or by means of an interconnecting link to a mounting shoe that is guided for movement lengthwise along the track. Typically, the sash arm is positioned opposite the track when the window is closed with the inside edge of the sash arm aligning with the inside edge of the track to ensure tight closing of the window.

Although somewhat useful and popular, conventional sash-type window arrangements suffer from some important drawbacks. Some of these drawbacks include that conventional window construction are not well suited to resist the potential for window failure in the event of the window assembly being subjected to certain types of weather condition such as strong winds.

During storms, winds of high velocity typically cause a zone of high air pressure on and adjacent walls of buildings, relative to the air pressure within the building and relative to the air pressure within the sashes of windows located on the walls, particularly if the windows are snugly mounted. The high exterior air pressure typically generates a partial vacuum within the window sashes.

In a strong storm, an exterior window may be subjected to winds in excess of 160 km per hour. Wind loading can be sustained or can occur in gusts and ripples. To withstand such loading, structures require both static and dynamic strength and resilience. Particularly, in the event that the window is subjected to a strong negative pressure, there is a risk that the shoe will be dismembered from the track.

Another main drawback associated with conventional sash-type window assemblies is the difficulty in aligning the window with the window frame. Also, it is often difficult to assemble the pivot assembly to the window frame.

Sash sag first occurs in casement and awning windows when the sash portion of the window is out of alignment with the frame. This misalignment between the window sash and frame can be caused by numerous factors including faulty installation of the window unit, settling of the building, warping caused by weathering or other factors.

A window having sash sag is not properly sealed and will potentially allow wind, moisture and dust to enter the building. This can disrupt the interior temperature and humidity as well as increase the amount of dust and germs. In turn, increased moisture, wind and dust not only disrupt the internal environment but can also cause damage to personal property. Furthermore, if sash sag is not corrected, moisture will seep into the broken seal and cause structural damage to the window frame and the surrounding supporting wall.

The prior art has shown some example of devices for providing adjustment to window sashes in order to correct misalignment with the corresponding window frames. However, such prior art devices are typically labor intensive, often requiring some disassembly of the hinge to make adjustments. This increases the time necessary for adjustment in the cost of producing complex adjustment devices.

Accordingly, there exists a need for an improved window hinge. It is a general object of the present invention to provide an improved window hinge.

SUMMARY OF THE INVENTION

In accordance with the present invention, there is provided a window hinge for pivotally connecting a window having a window sash to a window frame, the window hinge comprising: an elongated track defining a track longitudinal axis; the track having a track base wall attachable to the window frame; the track base wall having a base wall first surface for contacting the window frame and an opposed base wall second surface, the track base wall defining a base wall first end, a longitudinally opposed base wall second end, a longitudinally extending base wall first longitudinal edge and an opposed base wall second longitudinal edge; a track flange extending from at least a portion of the base wall first longitudinal edge substantially perpendicularly relative to the base wall second surface, the track flange defining a flange retaining section; a track attachment means for attaching the track to the window frame;—an elongated sash arm attachable to the window sash, the sash arm defining a sash arm longitudinal axis, a sash arm first end and a longitudinally opposed sash arm second end; a sash arm attachment means for attaching the sash arm to the window sash; a carriage component, the carriage component being pivotally attached to the sash arm adjacent the sash arm first end, the carriage component being also mounted on the base wall second surface in a carriage operational configuration for slidable movement along the track longitudinal axis between an open window position and a closed window position while being guided by the track flange and retained by the flange retaining section; a support arm for pivotally linking the sash arm and the track, the support arm defining a support arm first end and a longitudinally opposed support arm second end, the support arm adjacent the support arm first end being pivotally attached to the sash arm intermediate the sash arm first and second ends and the support arm adjacent the support arm second end being pivotally attached to the track base wall adjacent the base wall first end; a securing means other then the flange retaining section extending between the track base wall and the carriage component for maintaining the carriage component in the carriage operational configuration; whereby the securing means prevents the carriage component from being separated from the flange retaining section when pressure is exerted on the window.

Conveniently, the carriage component is provided with a retaining slot formed therein, the retaining slot being configured, sized and positioned to slidably receive the flange retaining section.

Typically, the carriage component defines a carriage first main surface and a substantially opposed carriage second main surface, the retaining slot being formed in the carriage first main surface; whereby the flange retaining section slides within the retaining slot when the carriage second main surface slides on the base wall second surface.

Conveniently, the track flange includes a flange spacing segment extending from the track base wall, the flange spacing segment defining a spacing segment distal edge positioned away from the track base wall, the flange retaining section extending from the spacing segment distal edge.

Typically, the flange retaining section has a substantially "L"-shaped configuration; the flange retaining section including a retaining section first arm extending substantially perpendicularly from the flange spacing segment in an overlying relationship with the base wall second surface and a retaining section second arm extending substantially perpendicularly from the retaining section first arm in a substantially parallel and spaced relationship with the flange spacing segment; the retaining section second arm being inserted in the retaining slot.

Conveniently, the securing means includes a securing recess formed in the carriage first main surface, the securing recess allowing the carriage component to slide between the open and closed window positions; and a securing protrusion protruding from the base wall second surface, the securing protrusion being configured, sized and positioned so as to be inserted in the securing recess when the carriage component is in the closed window position and so as to cooperate with the securing recess for maintaining the carriage component in the operational configuration; whereby the securing protrusion is adapted to abuttingly contact an inner surface of the securing recess for preventing the carriage component from being separated from the track when pressure is exerted on the window.

In one embodiment of the invention, the securing protrusion includes a punched-up portion of the track base wall.

In one embodiment of the invention, the securing protrusion has substantially the configuration of a cupola truncated in half.

Typically, the securing means includes a securing recess formed in the carriage first main surface, the securing recess allowing the carriage component to slide between the open and closed window positions; and a securing protrusion protruding from the base wall second surface, the securing protrusion being configured, sized and positioned so as to be inserted in the securing recess when the carriage component is in the closed window position and so as to cooperate with the securing recess for maintaining the retaining section second arm inserted in the retaining slot; whereby the securing protrusion is adapted to abuttingly contact an inner surface of the securing recess for preventing the carriage component from being separated from the track when pressure is exerted on the window.

In another embodiment of the invention, the securing means includes a securing flange extending opposite the track flange substantially adjacent to the carriage component.

In one embodiment of the invention, the securing flange extends from at least a portion of the base wall second longitudinal edge substantially perpendicularly relative to the base wall second surface.

In another embodiment of the invention, the securing flange includes a securing flange first segment extending from at least a portion of the base wall second longitudinal edge substantially perpendicularly relative to the base wall second surface and a securing flange second segment extending substantially perpendicularly from the securing flange first segment in an overlying relationship with the base wall second surface towards the track flange.

In yet another embodiment of the invention, the window hinge further includes an elongated securing component positioned adjacent the track in a substantially parallel relationship with the latter, the securing component including a securing component base wall extending in a substantially coplanar relationship with the track base wall, the securing flange extending substantially perpendicularly from the securing component base wall.

Conveniently, the carriage component also includes a first and a second carriage component auxiliary surfaces both extending between the carriage component first and second main surfaces, the carriage component first auxiliary surface being in a substantially proximal relationship with the flange spacing segment; the securing means includes a securing flange extending opposite the track flange substantially adjacent to the carriage second auxiliary surface.

In one embodiment of the invention, the support arm is pivotally attached to the track base wall by a support-to-base wall pivotal connection allowing adjustment of the longitudinal position of a pivotal axis thereof along the base wall longitudinal axis.

Conveniently, the support arm is pivotally attached to the track base wall by a support-to-base wall pivotal connection, the support-to-base wall pivotal connection including a pivotal connection aperture formed in the support arm substantially adjacent to the support arm second end; the support-to-base wall pivotal connection also including a mounting clip, the mounting clip having a clip base defining a clip base first surface and a clip base second surface; the clip base first surface having a substantially centrally positioned base recess formed therein; the mounting clip also having at least two clip prongs extending the clip base second surface, each of the clip prongs being provided with a prong retaining lip extending substantially outwardly therefrom; the clip prongs being insertable within the pivotal connection aperture; the clip prongs being movable between a locking configuration wherein the clip prongs are in a relatively spaced relationship relative to each other with the prong retaining lips preventing retraction of the clip prongs from the pivotal connection and an unlocked configuration wherein the clip prongs are in a relatively proximal relationship relative to each other so as to allow retraction thereof from the pivotal connection aperture; the support-to-base wall pivotal connection further including a clip-to-track attachment means for attaching the mounting clip to the track.

Typically, the clip-to-track attachment means includes an attachment pin extending between the clip base and the track.

In another embodiment of the invention, the attachment pin is offset relative to the center of the clip base so that rotation of the clip base relative to the track will change the longitudinal position of a pivotal axis of the support-to-base wall pivotal connection along the base wall longitudinal axis.

Typically, the window hinge further comprises a base seat extending from the track second base wall for receiving the clip base and allowing selective rotation thereof.

In accordance with the present invention, there is also provided a window hinge for pivotally connecting a window having a window sash to a window frame, the window hinge comprising: an elongated track defining a track longitudinal axis; the track having a track base wall attachable to the window frame; the track base wall having a base wall first surface for contacting the window frame and an opposed base wall second surface, the track base wall defining a base wall first end, a longitudinally opposed base wall second end, a longitudinally extending base wall first longitudinal edge and an opposed base wall second longitudinal edge; a track flange extending from at least a portion of the base wall first longitudinal edge substantially perpendicularly relative to the base wall second surface, the track flange defining a flange retaining section; a track attachment means for attaching the track to the window frame;—an elongated sash arm attachable to the window sash, the sash arm defining a sash arm longitudinal axis, a sash arm first end and a longitudinally opposed sash arm second end; a sash arm attachment means for attaching the sash arm to the window sash; a carriage component, the carriage component being pivotally attached to the sash arm adjacent the sash arm first end, the carriage component being also mounted on the base wall second surface in a carriage operational configuration for slidable movement along the track longitudinal axis between an open window position and a closed window position while being guided by the track flange and retained by the flange retaining section; a support arm for pivotally linking the sash arm and the track, the support arm defining a support arm first end and a longitudinally opposed support arm second end, the support arm adjacent the support arm first end being pivotally attached to the sash arm intermediate the sash arm first and second ends and the support arm adjacent the support arm second end being pivotally attached to the track base wall adjacent the base wall first end; the support arm being pivotally attached to the track base wall by a support-to-base wall pivotal connection allowing adjustment of the longitudinal position of a pivotal axis thereof along the base wall longitudinal axis.

Conveniently, the support-to-base wall pivotal connection includes a pivotal connection aperture formed in the support arm substantially adjacent to the support arm second end; the support-to-base wall pivotal connection also including a mounting clip, the mounting clip having a clip base defining a clip base first surface and a clip base second surface; the clip base first surface having a substantially centrally positioned base recess formed therein; the mounting clip also having at least two clip prongs extending the clip base second surface, each of the clip prongs being provided with a prong retaining lip extending substantially outwardly therefrom; the clip prongs being insertable within the pivotal connection aperture; the clip prongs being movable between a locking configuration wherein the clip prongs are in a relatively spaced relationship relative to each other with the prong retaining lips preventing retraction of the clip prongs from the pivotal connection and an unlocked configuration wherein the clip prongs are in a relatively proximal relationship relative to each other so as to allow retraction thereof from the pivotal connection aperture; the support-to-base wall pivotal connection further including a clip-to-track attachment means for attaching the mounting clip to the track.

Typically, the clip-to-track attachment means includes an attachment pin extending between the clip base and the track.

Conveniently, the attachment pin is offset relative to the center of the clip base so that rotation of the clip base relative to the track will change the longitudinal position of a pivotal axis of the support-to-base wall pivotal connection along the base wall longitudinal axis.

In one embodiment of the invention, the window hinge further comprises a base seat extending from the track second base wall for receiving the clip base and allowing selective rotation thereof.

Advantages of the present invention include that the proposed window hinge is provided with features allowing to withstand and/or resist loadings imparted thereon by weather conditions such as strong winds. More specifically, the proposed window hinge reduces the risk that the shoe component will be dismembered from the track or rail.

Also, the proposed window hinge is provided with features for facilitating attachment of the linkage arm to the track through a set of quick and ergonomical steps without the need for special tooling or manual dexterity. Furthermore, the proposed window hinge allows for adjustment of the relative positioning between the supporting and track arms, typically through a range of 1.5 mm. or less. The adjustment can be effected through a set of quick and ergonomical steps without requiring special tooling or manual dexterity.

Still furthermore, the proposed window hinge is specifically designed so as to provide the hereinabove mentioned features while being manufacturable through a set of conventional manufacturing steps, using conventional material so as to provide a window hinge that will be economically feasible, long lasting and relatively trouble free in operation.

BRIEF DESCRIPTION OF THE DRAWINGS

Various embodiments of the present invention will now be disclosed, by way of example, in reference to the following drawings in which.

DETAILED DESCRIPTION

Figures 1, 2:
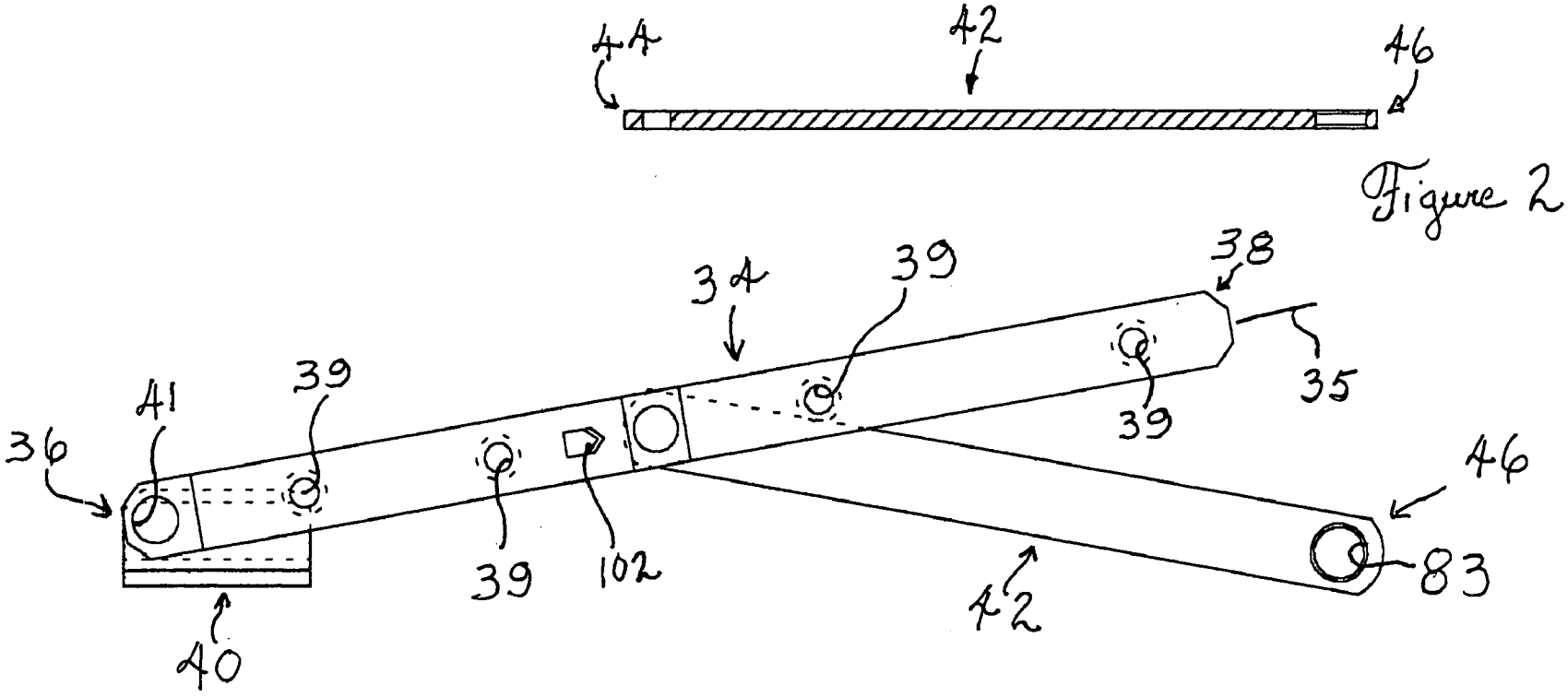
FIG. 1: in a top view, illustrates a sash arm, a support arm and a carriage component, all part of a window hinge assembly, in accordance with an embodiment of the present invention, pivotally attached together.
FIG. 2: in a longitudinal cross sectional view, illustrates the configuration of the support arm shown in FIG. 1.

Referring to the drawings, there is shown a window hinge in accordance with an embodiment of the present invention generally designated by the reference numeral 10. The window hinge 10 is intended to be used typically in association with a window frame and a window sash (both not shown). The window sash and window frame may be formed out of any suitable material, such as wood, metal or polymeric resin.

As is well known in the art, the window frame typically has an inner side defined by a wall and is shaped with a recess to receive a weather stripping material. An outer wall of the window frame co-acts with an internal wall and a transverse wall to define a recess which receives a part of the window hinge.

The window sash typically has an inner wall which abuts against the weather stripping in the recess of the wall and is shaped at its lower end to provide a recess for receiving weather stripping that will tightly engage the outer wall of the frame when the window is closed. An internal wall and a transverse wall of the window sash together define a recess for receiving part of the window hinge 10.

It should be understood that the proposed window hinge 10 could be used in other settings or contexts and with other types of window frames and window sashes without departing from the scope of the present invention.

Figures 3, 4, 5:
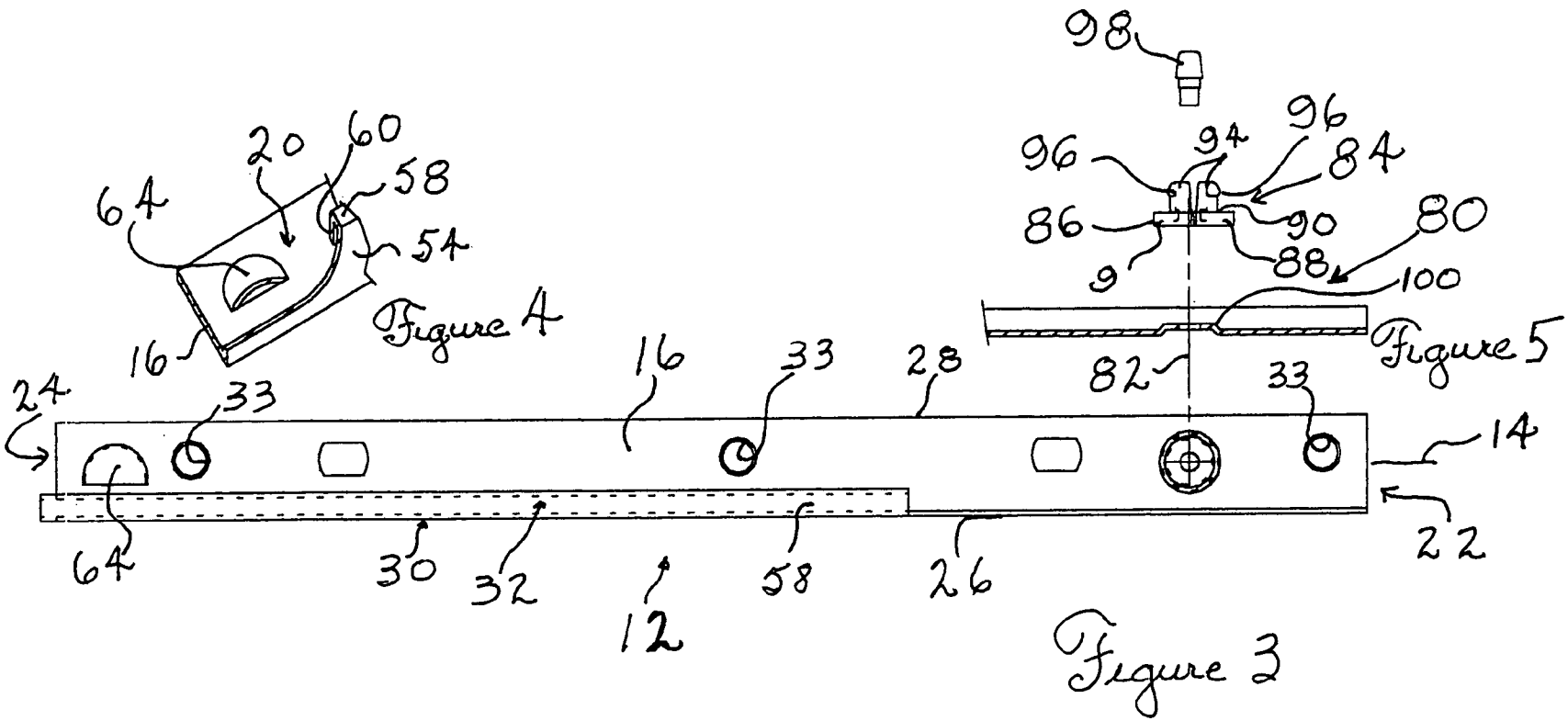
FIG. 3: in a top view, illustrates a track, part of a window hinge assembly, in accordance with an embodiment of the present invention.
FIG. 4: in a partial perspective view, illustrates a portion of the track shown in FIG. 3.
FIG. 5: in a partial exploded and longitudinal cross sectional view, illustrates the relationship between the track shown in FIG. 3 and attachment components used for attaching the support arm thereto.
Figures 6, 7:
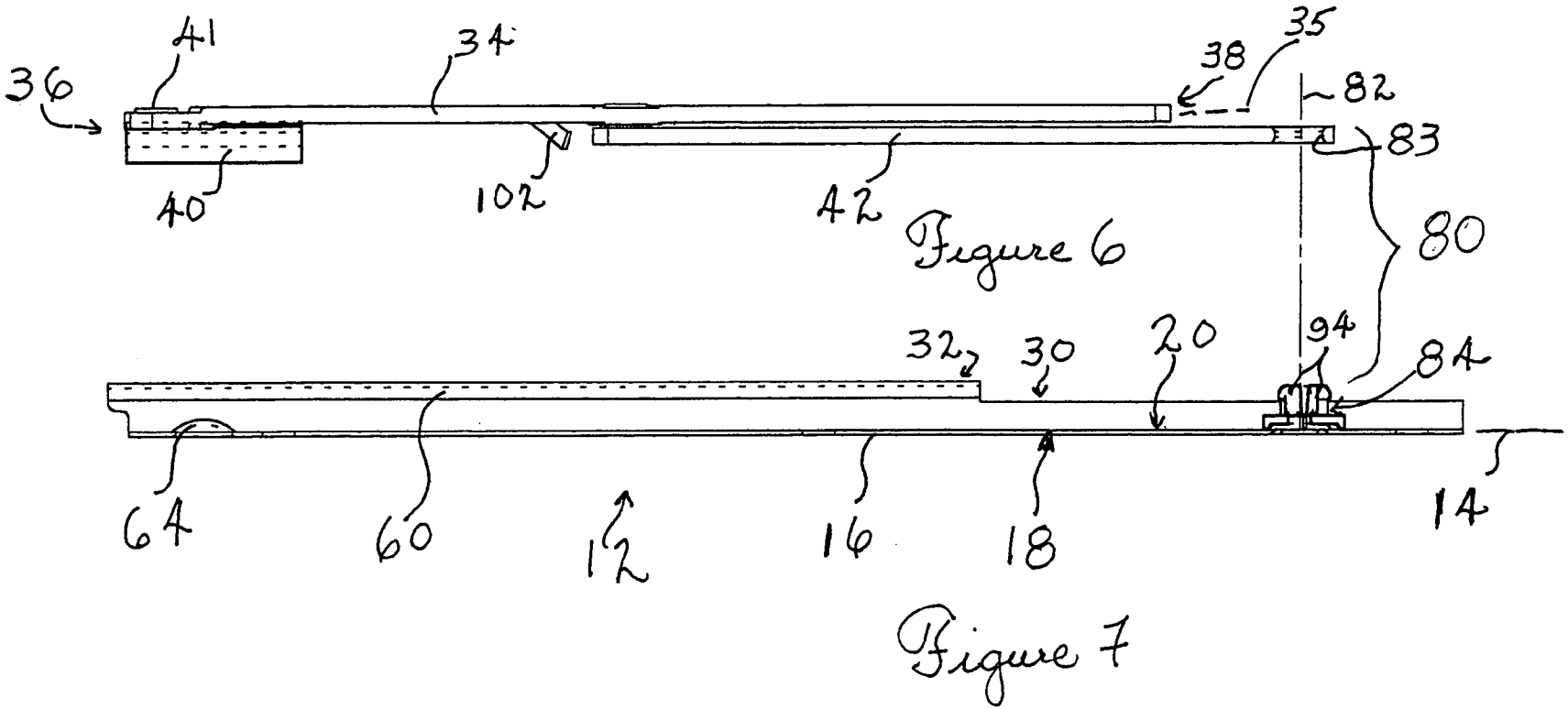
FIG. 6: in a side view, illustrates the combination of a sash arm, a support arm and a carriage component such as shown in FIG. 1.
FIG. 7: in a side view, illustrates a track such as shown in FIG. 3 having attachment components such as shown in FIG. 5 mounted thereto.

As shown in FIG. 3, the window hinge 10 typically includes an elongated track 12 defining a track longitudinal axis 14. The track 12 has a track base wall 16 attachable to the window frame. As shown in FIG. 7, the track base wall 16 has a base wall first surface 18 for contacting the window frame and an opposed base wall second surface 20.

As shown in FIG. 3, the track base wall 16 defines a base wall first end 22, a longitudinally opposed base wall second end 24, a longitudinally extending base wall first longitudinal edge 26 and an opposed base wall second longitudinal edge 28. As shown in FIG. 7, a track flange 30 extends from at least a portion of the base wall first longitudinal edge 26 substantially perpendicularly relative to the base wall second surface 20. The track flange 30 defines a flange retaining section 32.

The window hinge 10 also includes a track attachment means for attaching the track 12 to the window frame. Typically, the track attachment means includes track attachment apertures 33 extending through the track base wall 16 for receiving conventional attachment components such as screws or the like.

As shown more specifically in FIGS. 1 and 6, the window hinge 10 further includes an elongated sash arm 34 attachable to the window sash. The sash arm 34 defines a sash arm longitudinal axis 35, a sash arm first end 36 and a longitudinally opposed sash arm second end 38.

The window hinge 10 still further includes a sash arm attachment means for attaching the sash arm to the window sash. Typically, the sash arm attachment means includes track attachment apertures 39 extending through the sash arm 34 for receiving conventional attachment components such as screws or the like.

As shown more specifically in FIGS. 1, 6 and 8 through 11, the window hinge 10 also includes a carriage component 40. The carriage component 40 is pivotally attached to the sash arm 34 adjacent the sash arm first end 36 by a pivotal connection 41.

The carriage component 40 is also mounted on the base wall second surface 20 in a carriage operational configuration for slidable movement along the track longitudinal axis 14 between an open window position and a closed window position while being guided by the track flange 30 and retained by the flange retaining section 32.

As shown in FIGS. 1, 2 and 6, the window hinge 10 also includes a support arm 42 for pivotally linking the sash arm 34 and the track 12. The support arm 42 defines a support arm first end 44 and a longitudinally opposed support arm second end 46.

The support arm 42 adjacent the support arm first end 44 is pivotally attached to the sash arm 34 intermediate the sash arm first and second ends 36, 38. The support arm 42 adjacent the support arm second end 46 is pivotally attached to the track base wall 16 adjacent the base wall first end 22.

The window hinge 10 further includes a securing means other then the flange retaining section 32 extending between the track base wall 16 and the carriage component 40 for maintaining the carriage component 40 in the carriage operational configuration. The securing means prevents the carriage component 40 from being separated from the flange retaining section 32 when pressure such as a negative pressure is exerted on the window.

As shown in FIGS. 8 through 11, the carriage component 40 is typically provided with a retaining slot 48 formed therein. The retaining slot 48 is configured, sized and positioned to slidably receive the flange retaining section 32.

Typically, the carriage component 40 defines a carriage first main surface 50 and a substantially opposed carriage second main surface 52. The retaining slot 48 is typically formed in the carriage first main surface 50. The flange retaining section 32 slides within the retaining slot 48 when the carriage second main surface 52 slides on the base wall second surface 20.

Conveniently, the track flange 30 includes a flange spacing segment 54 extending from the track base wall 16. The flange spacing segment 54 defines a spacing segment distal edge 56 positioned away from the track base wall 16. The flange retaining section 32 extends from the spacing segment distal edge 56.

Typically, the flange retaining section 32 has a substantially "L"-shaped configuration. The flange retaining section 32 includes a retaining section first arm 58 extending substantially perpendicularly from the flange spacing segment 54 in an overlying relationship with the base wall second surface 20 and a retaining section second arm 60 extending substantially perpendicularly from the retaining section first arm 58 in a substantially parallel and spaced relationship with the flange spacing segment 54. The retaining section second arm 60 is inserted in the retaining slot 48.

A limiting leg 102 typically protrudes from the sash arm 34 for abuttingly limiting the pivotal range thereof.

In an embodiment of the invention shown more specifically in FIGS. 1 through 8, the securing means includes a securing recess 62 formed in the carriage second main surface 52. The securing recess 62 allows the carriage component 40 to slide between the open and closed window positions.

The securing means also includes a securing protrusion 64 protruding from the base wall second surface 20. The securing protrusion 64 is configured, sized and positioned so as to be inserted in the securing recess 62 when the carriage component 40 is in the closed window position and so as to cooperate with the securing recess 62 for maintaining the carriage component 40 in the operational configuration. The securing protrusion 64 is adapted to abuttingly contact an inner surface of the securing recess 62 for preventing the carriage component 40 from being separated from the track 12 when pressure is exerted on the window.

Figure 8:
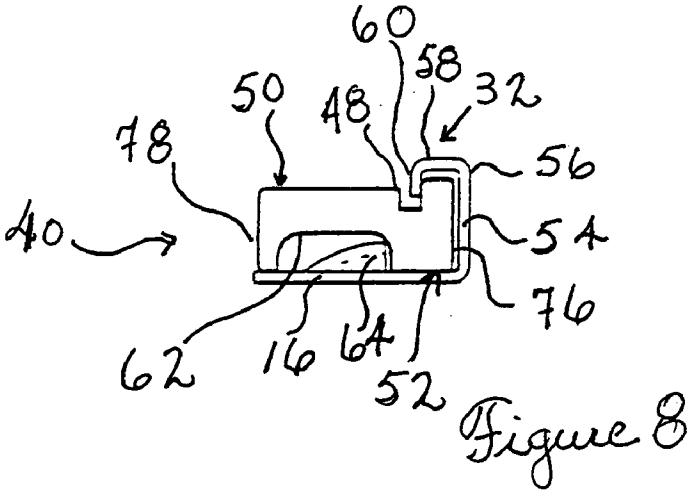
FIG. 8: in a side end view, illustrates the relationship between the carriage component shown in FIG. 6 and the track component shown in FIG. 7 when assembled together.

In one embodiment of the invention shown in FIGS. 3, 4 and 8, the securing protrusion 64 includes a punched-up portion of the track base wall 16. In such an embodiment of the invention, the securing protrusion 64 typically has substantially the configuration of a cupola truncated in half.

Figure 9:
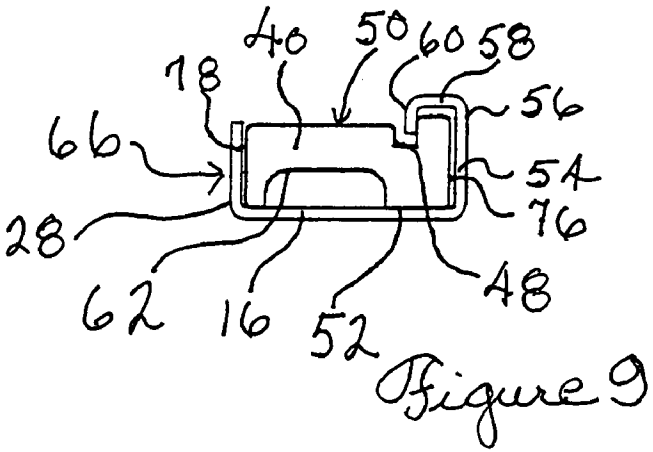
FIG. 9: in a side end view, illustrates a carriage component and a track in accordance with an alternative embodiment of the invention.
Figure 11:
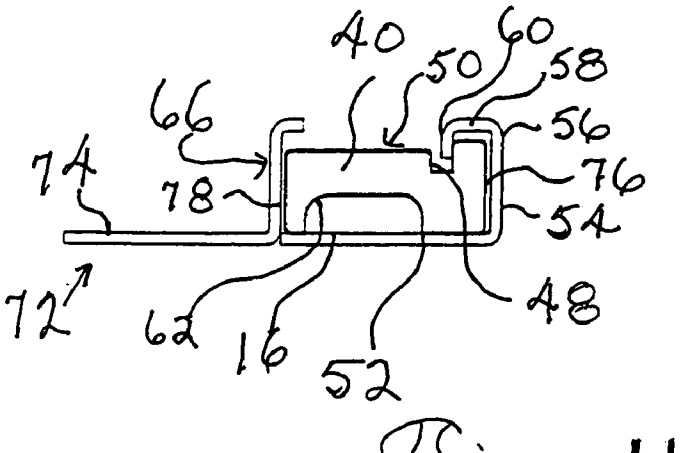
FIG. 11: in a side end view, illustrates a carriage component and a track in accordance with still yet another alternative embodiment of the invention.
Figure 10:
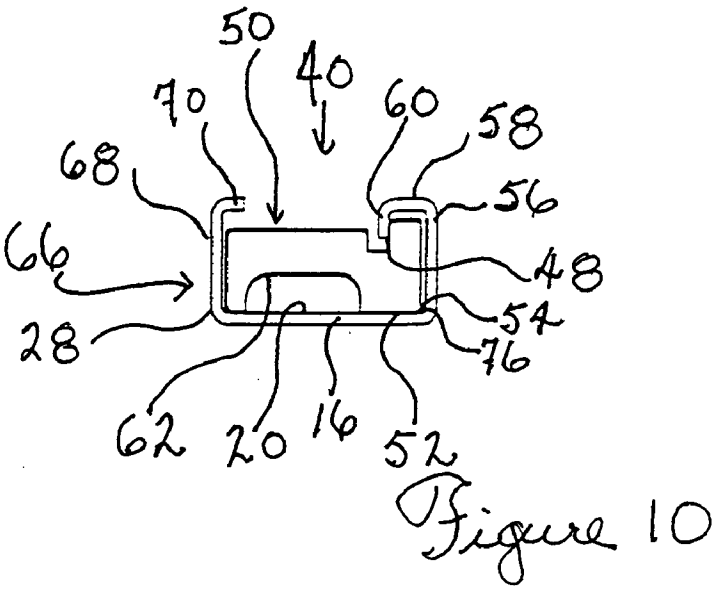
FIG. 10: in a side end view, illustrates a carriage component and a track in accordance with yet another alternative embodiment of the invention.

In another embodiment of the invention shown in FIGS. 9 through 11, the securing means includes a securing flange 66 extending opposite the track flange 30 substantially adjacent to the carriage component 40.

In one embodiment of the invention shown in FIGS. 9 and 10, the securing flange 66 extends from at least a portion of the base wall second longitudinal edge 28 substantially perpendicularly relative to the base wall second surface 20.

In the embodiment of the invention shown in FIG. 10, the securing flange 66 includes a securing flange first segment 68 extending from at least a portion of the base wall second longitudinal edge 28 substantially perpendicularly relative to the base wall second surface 20 and a securing flange second segment 70 extending substantially perpendicularly from the securing flange first segment 68 in an overlying relationship with the base wall second surface 20 towards the track flange 30.

In the embodiment of the invention shown in FIG. 11, the window hinge 10 further includes an elongated securing component 72 positioned adjacent the track 12 in a substantially parallel relationship with the latter. The securing component 72 includes a securing component base wall 74 extending in a substantially coplanar relationship with the track base wall 16. In such an embodiment, the securing flange 66 extends substantially perpendicularly from the securing component base wall 74.

Conveniently, the carriage component 40 also includes a first and a second carriage component auxiliary surfaces 76, 78 both extending between the carriage component first and second main surfaces 50, 52. The carriage component first auxiliary surface 76 is in a substantially proximal relationship with the flange spacing segment 54. Typically, the securing flange 66 extends opposite the track flange 30 substantially adjacent to the carriage second auxiliary surface 78.

In one embodiment of the invention, the support arm 42 is pivotally attached to the track base wall 16 by a support-to-base wall pivotal connection 80 allowing adjustment of the longitudinal position of a pivotal axis 82 thereof along the track longitudinal axis 14.

Typically, the support-to-base wall pivotal connection 80 including a pivotal connection aperture 83 formed in the support arm 42 substantially adjacent to the support arm second end 46. As shown more specifically in FIG. 5, the support-to-base wall pivotal connection 80 also includes a mounting clip 84. The mounting clip 84 has a clip base 86 defining a clip base first surface 88 and a clip base second surface 90.

The clip base first surface 88 has a substantially centrally positioned base recess 92 formed therein. The mounting clip 84 also has at least two clip prongs 94 extending the clip base second surface 90. Each of the clip prongs 94 is provided with a corresponding prong retaining lip 96 extending substantially outwardly therefrom.

The clip prongs 94 are insertable within the pivotal connection aperture 83. The clip prongs 94 are movable between a locking configuration wherein the clip prongs 94 are in a relatively spaced relationship relative to each other with the prong retaining lips 96 preventing retraction of the clip prongs 94 from the pivotal connection and an unlocked configuration wherein the clip prongs 94 are in a relatively proximal relationship relative to each other so as to allow retraction thereof from the pivotal connection aperture 83.

The support-to-base wall pivotal connection 80 further including a clip-to-track attachment means for attaching the mounting clip 84 to the track 12. Typically, the clip-to-track attachment means includes an attachment pin 98 extending between the clip base 86 and the track 12.

Preferably, the attachment pin 98 is offset relative to the center of the clip base 86 so that rotation of the clip base 86 relative to the track 12 will change the longitudinal position of the pivotal axis 82 of the support-to-base wall pivotal connection 80 along the track longitudinal axis 14.

Typically, the window hinge 10 further comprises a base seat 100 extending from the base wall second surface for receiving the base recess 92 and allowing selective rotation of the mounting clip 84. Hence, in use, by merely rotating the mounting clip 84 using a conventional tool, such as a pliers, a ratchet or the like, fine adjustments in the order of 1.5 mm or the like of the relative positioning between the support arm 42 and the track 12 can be accomplished.

The embodiments of the invention in which an exclusive privilege or property is claimed are defined as follows:

1. A window hinge for pivotally connecting a window having a window sash to a window frame, said window hinge comprising:

an elongated track defining a track longitudinal axis; said track having a track base wall attachable to said window frame; said track base wall having a base wall first surface for contacting said window frame and an opposed base wall second surface, said track base wall defining a base wall first end, a longitudinally opposed base wall second end, a longitudinally extending base wall first longitudinal edge and an opposed base wall second longitudinal edge;

a track flange extending from at least a portion of said base wall first longitudinal edge substantially perpendicularly relative to said base wall second surface, said track flange defining a flange retaining section;

a track attachment means for attaching said track to said window frame;

an elongated sash arm attachable to said window sash, said sash arm defining a sash arm longitudinal axis, a sash arm first end and a longitudinally opposed sash arm second end;

a sash arm attachment means for attaching said sash arm to said window sash;

a carriage component, said carriage component being pivotally attached to said sash arm adiacent said sash arm first end, said carriage component being also mounted on said base wall second surface in a carriage operational configuration for slidable movement along said track longitudinal axis between an open window position and a closed window position while being guided by said track flange and retained by said flange retaining section;

a support arm for pivotally linking said sash arm and said track, said support arm defining a support arm first end and a longitudinally opposed support arm second end, said support arm adiacent said support arm first end being pivotally attached to said sash arm intermediate said sash arm first and second ends and said support arm adiacent said support arm second end being pivotally attached to said track base wall adiacent said base wall first end;

a securing means other then said flange retaining section extending between said track base wall and said carriage component for maintaining said carriage component in said carriage operational configuration; whereby said securing means prevents said carriage component from being separated from said flange retaining section when pressure is exerted on said window;

securing means including a securing recess formed in said carriage first main surface, said securing recess allowing said carriage component to slide between said open and closed window positions; and a securing protrusion protruding from said base wall second surface, said securing protrusion being configured, sized and positioned so as to be inserted in said securing recess when said carriage component is in said closed window position and so as to cooperate with said securing recess for maintaining said carriage component in said operational configuration; whereby said securing protrusion is adapted to abuttingly contact an inner surface of said securing recess for preventing said carriage component from being separated from said track when pressure is exerted on said window.

2. A window hinge as recited in claim 1 wherein said securing protrusion includes a punched-up portion of said track base wall.

3. A window hinge as recited in claim 1 wherein said securing protrusion has substantially the configuration of a cupola truncated in half.

4. A window hinge for pivotally connecting a window having a window sash to a window frame, said window hinge comprising:

an elongated track defining a track longitudinal axis; said track having a track base wall attachable to said window frame; said track base wall having a base wall first surface for contacting said window frame and an opposed base wall second surface, said track base wall defining a base wall first end, a longitudinally opposed base wall second end, a longitudinally extending base wall first longitudinal edge and an opposed base wall second longitudinal edge;

a track flange extending from at least a portion of said base wall first longitudinal edge substantially perpendicularly relative to said base wall second surface, said track flange defining a flange retaining section;

a track attachment means for attaching said track to said window frame;

an elongated sash arm attachable to said window sash, said sash arm defining a sash arm longitudinal axis, a sash arm first end and a longitudinally opposed sash arm second end;

a sash arm attachment means for attaching said sash arm to said window sash;

a carriage component, said carriage component being pivotally attached to said sash arm adiacent said sash arm first end, said carriage component being also mounted on said base wall second surface in a carriage operational configuration for slidable movement along said track longitudinal axis between an open window position and a closed window position while being guided by said track flange and retained by said flange retaining section;

a support arm for pivotally linking said sash arm and said track, said support arm defining a support arm first end and a longitudinally opposed support arm second end, said support arm adiacent said support arm first end being pivotally attached to said sash arm intermediate said sash arm first and second ends and said support arm adiacent said support arm second end being pivotally attached to said track base wall adiacent said base wall first end;

a securing means other then said flange retaining section extending between said track base wall and said carriage component for maintaining said carriage component in said carriage operational configuration; whereby said securing means prevents said carriage component from being separated from said flange retaining section when pressure is exerted on said window;

said carriage component being provided with a retaining slot formed therein, said retaining slot being configured, sized and positioned to slidably receive said flange retaining section; said carriage component defining a carriage first main surface and a substantially opposed carriage second main surface, said retaining slot being formed in said carriage first main surface; said track flange including a flange spacing segment extending from said track base wall, said flange spacing segment defining a spacing segment distal edge positioned away from said track base wall, said flange retaining section extending from said spacing segment distal edge; said flange retaining section having a substantially "L"-shaped configuration; said flange retaining section including a retaining section first arm extending substantially perpendicularly from said flange spacing segment in an overlying relationship with said base wall second surface and a retaining section second arm extending substantially perpendicularly from said retaining section first arm in a substantially parallel and spaced relationship with said flange spacing segment; said retaining section second arm being inserted in said retaining slot;

said securing means including a securing recess formed in said carriage first main surface, said securing recess allowing said carriage component to slide between said open and closed window positions; and a securing protrusion protruding from said base wall second surface, said securing protrusion being configured, sized and positioned so as to be inserted in said securing recess when said carriage component is in said closed window position and so as to cooperate with said securing recess for maintaining said retaining section second arm inserted in said retaining slot; whereby said flange retaining section slides within said retaining slot when said carriage second main surface slides on said base wall second surface and said securing protrusion is adapted to abuttingly contact an inner surface of said securing recess for preventing said carriage component from being separated from said track when pressure is exerted on said window.

* * * * *